US008120549B2

(12) United States Patent
Takagi et al.

(10) Patent No.: US 8,120,549 B2
(45) **Date of Patent: *Feb. 21, 2012**

(54) METHOD FOR DRIVING A PLASMA DISPLAY PANEL

(75) Inventors: Kazushige Takagi, Kawasaki (JP); Tadayoshi Kosaka, Kawasaki (JP)

(73) Assignee: Hitachi Ltd., Tokyo (JP)

( * ) Notice: Subject to any disclaimer, the term of this patent is extended or adjusted under 35 U.S.C. 154(b) by 1098 days.

This patent is subject to a terminal disclaimer.

(21) Appl. No.: 12/000,014

(22) Filed: Dec. 6, 2007

(65) Prior Publication Data

US 2008/0094316 A1 Apr. 24, 2008

Related U.S. Application Data

(63) Continuation of application No. 10/799,663, filed on Mar. 15, 2004, now Pat. No. 7,463,219.

(30) Foreign Application Priority Data

Oct. 2, 2003 (JP) ..... 2003-344648

(51) Int. Cl.
*G09G 3/28* (2006.01)

(52) U.S. Cl. ..... 345/60; 345/66; 345/68

(58) Field of Classification Search ..... 345/60, 345/62–63, 66, 76–79, 204, 214; 315/169.3, 315/169.4; 313/309, 336
See application file for complete search history.

(56) References Cited

U.S. PATENT DOCUMENTS

| | | | | |
|---|---|---|---|---|
| 4,349,819 | A | 9/1982 | Terakawa | |
| 5,642,018 | A | 6/1997 | Marcotte | |
| 6,100,859 | A | 8/2000 | Kuriyama et al. | |
| 6,175,192 | B1 | 1/2001 | Moon | |
| 6,426,732 | B1 | 7/2002 | Makino | |
| 6,653,993 | B1 * | 11/2003 | Nagao et al. | 345/60 |
| 6,724,356 | B1 | 4/2004 | Kojima et al. | |
| 6,753,833 | B2 | 6/2004 | Seo et al. | |
| 6,784,857 | B1 | 8/2004 | Nakamura | |
| 6,791,516 | B2 * | 9/2004 | Kang | 345/63 |
| 6,891,519 | B2 | 5/2005 | Ooe et al. | |
| 6,900,781 | B1 | 5/2005 | Mori et al. | |
| 6,933,911 | B2 * | 8/2005 | Suzuki | 345/60 |
| 7,463,219 | B2 * | 12/2008 | Takagi et al. | 345/63 |
| 7,710,359 | B2 * | 5/2010 | Kojima et al. | 345/63 |

(Continued)

FOREIGN PATENT DOCUMENTS

EP 1065645 1/2001

(Continued)

OTHER PUBLICATIONS

European Search Report dated Feb. 15, 2008 for European Patent Application No. 03 25 6640.

(Continued)

*Primary Examiner* — Richard Hjerpe
*Assistant Examiner* — Mansour M Said
(74) *Attorney, Agent, or Firm* — Staas & Halsey LLP

(57) ABSTRACT

The present method is to drive a plasma display panel which displays a frame composed of a plurality of sub-fields having different weights of luminance. The method comprises using plural kinds of application voltage waveforms different in light emission luminance, as pulse voltages for sustain discharges in display of each sub-field, and adjusting the number of waves in each of the plural kinds of application voltage waveforms according to the weight of luminance set for each sub-field, thereby performing gradation display.

5 Claims, 7 Drawing Sheets

U.S. PATENT DOCUMENTS

| | | | | |
|---|---|---|---|---|
| 2001/0005188 | A1 | 6/2001 | Watanabe | |
| 2001/0033263 | A1 * | 10/2001 | Yamada et al. | 345/89 |
| 2002/0008678 | A1 | 1/2002 | Rutherford | |

FOREIGN PATENT DOCUMENTS

| | | |
|---|---|---|
| EP | 1 152 387 | 11/2001 |
| JP | 7-134565 | 5/1995 |
| JP | 10-177363 | 6/1998 |
| JP | 10-333635 | 12/1998 |
| JP | 11-65523 | 3/1999 |
| JP | 2000-206928 | 7/2000 |
| JP | 2001-5423 | 1/2001 |
| JP | 2001-13913 | 1/2001 |
| JP | 2001-13919 | 1/2001 |
| JP | 2001-228820 | 8/2001 |
| JP | 2001-296834 | 10/2001 |
| JP | 2002-189443 | 7/2002 |
| JP | 2003-29700 | 1/2003 |
| JP | 2003-280571 | 10/2003 |
| JP | 2003-297000 | 10/2003 |
| KR | 2002-0061913 | 7/2002 |
| KR | 1020010003006 | * 7/2002 |
| KR | 1020020061913 | * 10/2002 |

OTHER PUBLICATIONS

English Abstract for KR 2002-61913 (publication date Jul. 25, 2002).
U.S. Appl. No. 10/799,663, filed Mar. 15, 2004, Kazushige Takagi et al., Hitachi, Ltd.

* cited by examiner

FIG. 1(a)
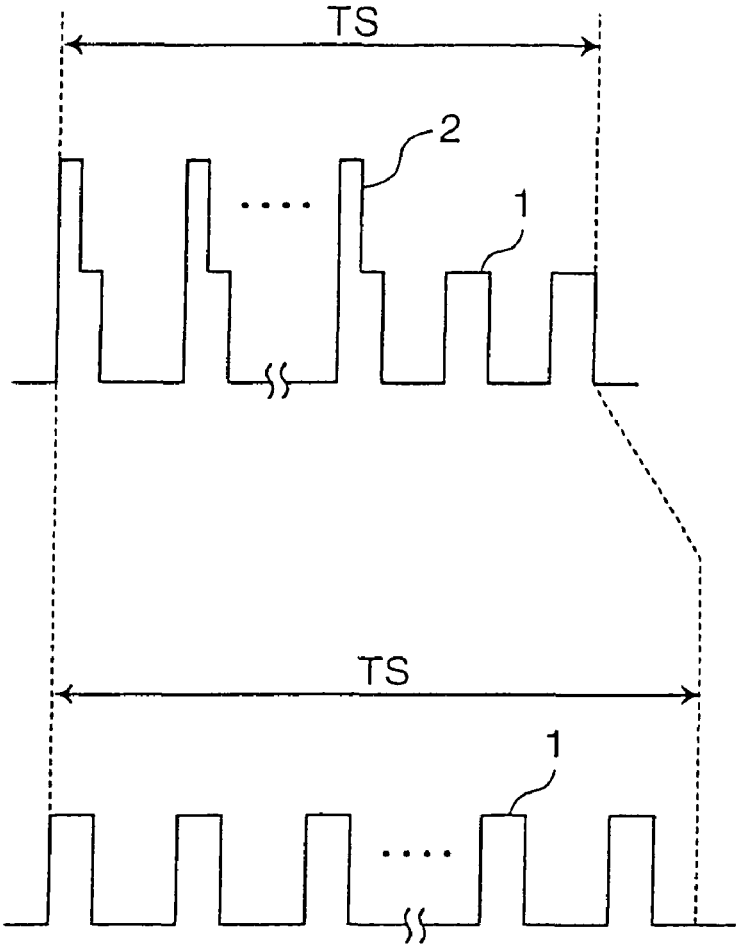
FIG. 1(b)
FIG. 2
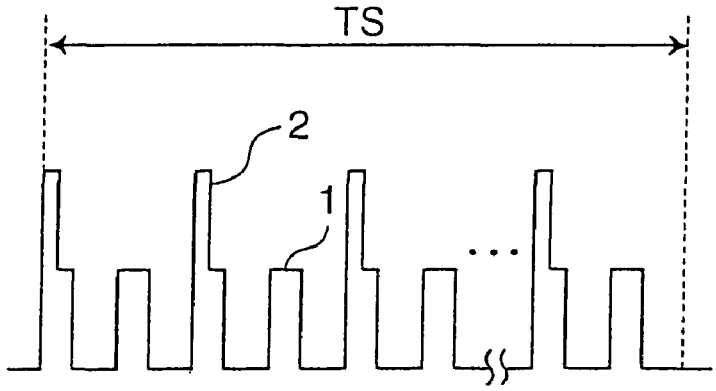

FIG. 7
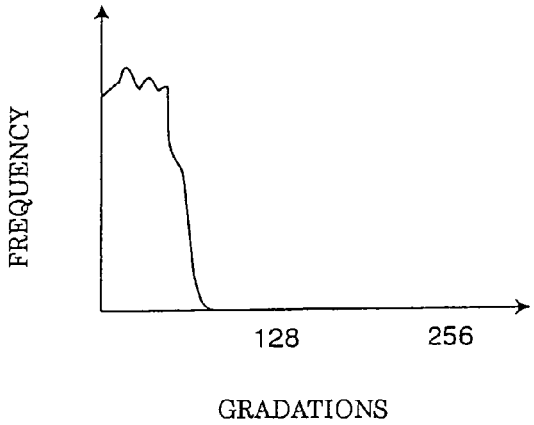
FIG. 8
| | CONSTITUENT RATE | 1SF | 2SF | 3SF | 4SF | 5SF | 6SF | 7SF | 8SF |
|---|---|---|---|---|---|---|---|---|---|
| COMPARATIVE EXAMPLE | 100% | 1 | 2 | 4 | 8 | 16 | 32 | 64 | 128 |
| CONSTITUTION(1) | 50% | 0.75 | 1.5 | 3 | 6 | 12 | 24 | 48 | 96 |
| CONSTITUTION(2) | 0% | 0.5 | 1 | 2 | 4 | 8 | 16 | 32 | 64 |
FIG. 9
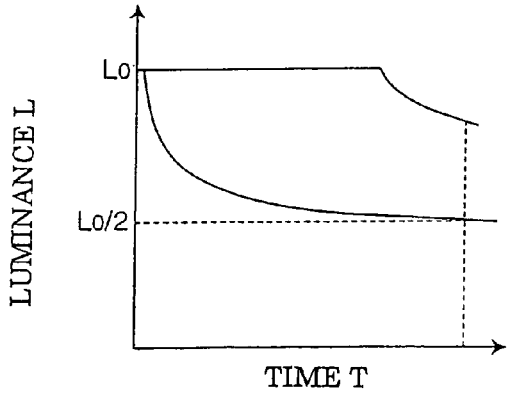

METHOD FOR DRIVING A PLASMA DISPLAY PANEL

CROSS-REFERENCE TO RELATED APPLICATIONS

This application is related to Japanese application No. 2003-344648 filed on Oct. 2, 2003, whose priority is claimed under 35 USC §119, the disclosure of which is incorporated by reference in its entirety. This application is a continuation of U.S. application Ser. No. 10/799,663, filed Mar. 15, 2004 now U.S. Pat. No. 7,463,219, which is incorporated by reference herein.

BACKGROUND OF THE INVENTION

1. Field of the Invention

The present invention relates to a method for driving a plasma display panel (hereafter, referred to as a PDP).

2. Description of Related Art

PDPs are low-profile display devices which exhibit an excellent visibility, which are capable of performing high-speed display and which are relatively easily achieve large screen display. PDPs of matrix type, especially a surface discharge type, are ones where display electrodes, used in pairs during application of a driving voltage, are arranged on the same substrate. PDPs of this type are suitable for phosphor color display.

As three-electrode surface-discharge color PDPs of an AC type, well-known ones include those disclosed in Japanese Unexamined Patent Publication Nos. HEI 11(1999)-65523, 2001-5423 and 2002-189443. For example, a PDP described in Japanese Unexamined Patent Publication 2002-189443 has a construction as follows: A PDP 10 comprises a front glass substrate 11 and a rear substrate 21, as shown in FIG. 10. On the front substrate 11, sustain electrodes (display electrodes) X and Y are provided on every line L and arranged substantially parallel to each other in a horizontal direction. The line L is a row of cells in the horizontal direction on a screen. The sustain electrodes X and Y are used for generating a surface discharge (a surface discharge is also referred to as a display discharge because it is a main discharge for display, or as a sustain discharge because it is a discharge for sustaining an illuminated state brought about by addressing).

The sustain electrodes X and Y are each formed of a transparent electrode 12 and a metal electrode (bus electrode) 13, and covered with a dielectric layer 17 of a low-melting glass. A protection film 18 of magnesium oxide (MgO) is provided on the surface of the dielectric layer 17.

A plurality of address electrodes A (also referred to as data electrodes) for generating an address discharge are formed on the rear substrate 21. The address electrodes A are covered with a dielectric layer 24. A large number of ribs (barrier ribs) 29 arranged in a stripe pattern are provided on the dielectric layer 24, in parallel to each other in a perpendicular direction (a direction crossing the sustain electrodes) in such a manner that the adjacent ribs sandwich the address electrode A. The ribs 29 partition a discharge space 30 on a subpixel-by-subpixel basis (unit-luminous—area basis) in a line direction and define the height of the discharge space 30.

Three color (R, G and B) phosphor layers 28R, 28G and 28B for color display are respectively provided in elongated grooves between the adjacent ribs. The layout pattern of three colors is a stripe pattern in which cells in one column have the same luminescent color and adjacent columns have different luminescent colors. The discharge space 30 is filled with a discharge gas of a mixture of neon as a main component and xenon, and the phosphor layers 28R, 28G and 28B are locally excited by ultraviolet light emitted by xenon during an electric discharge and emit light.

Each pixel (picture element) for display is constituted by three subpixels along the line L. A structural body within each subpixel is a discharge cell (display element). The ribs 29 are arranged in a stripe pattern as mentioned above and, therefore sections of the discharge space 30 corresponding to the respective columns are each continuous in the column direction across all the lines L. For this reason, the ratio of an inter-electrode spacing between the adjacent lines L (reverse slit) to a surface discharge gap of each line L is selected to be a value which enables discharge coupling to be prevented from generating in a column direction.

Display is performed as follows. A voltage is applied between the sustain electrode Y and the address electrode A so that address discharge is generated and a discharge cell to be lit is selected. Thereafter, a sustain voltage (sustain pulse) is applied to the sustain electrode X and to the sustain electrode Y, alternatively, so that a sustain discharge is generated.

FIG. 11 is a plan view of the PDP shown in FIG. 10. A fundamental minimum unit for light emission in the PDP is a sub-pixel (ordinarily referred to simply as a "discharge cell") C. One pixel P is composed of three sub-pixels: sub-pixel C (R) for R, sub-pixel C (G) for G, and sub-pixel C (B) for B, arranged side by side in the line direction. Color display in the PDP is performed by varying the level of gradation of each of R, G and B in one pixel P.

FIG. 12 is a diagram illustrating one example of the constitution of a field and driving voltage waveforms in the PDP shown in FIG. 10. For expressing gradation in the PDP by binary control on illumination, a frame F which is a time-sequential input image and is composed of a odd field f and an even field f, is divided into, for example, eight sub-fields sf1, sf2, sf3, sf4, sf5, sf6 sf7 and sf8 (numerical subscripts indicate the order in which the sub-fields are displayed). In other words, each field f is replaced with a group of eight sub-fields sf1 to sf8. The sub-fields sf1 to sf8 are assigned weights of luminance so that relative ratio of luminance in the sub-fields sf1 to sf8 becomes about 1:2:4:8: 16:32:64:128, and the numbers of light emissions in the sub-fields sf1 to sf8 are set according to the weights of luminance.

Since 256 levels of luminance can be set for each of the colors R, G and B by combining illumination and non-illumination on a sub-field basis when one field is composed of eight sub-fields, the number of displayable colors (the number of luminous colors) is $256^3$. A sub-field period Tsf allotted to each of the sub-fields sf1 to sf8 includes a reset period TR during which charge initialization is carried out in the discharge cells of the entire display screen, an address period TA during which a discharge cell to be lit is selected in the case of, for example, write type addressing, and a sustain period TS during which an illuminated state is sustained for ensuring the luminance according to a gradation level to be produced.

In each sub-field period Tsf, the reset period TR and the address period TA are constant in length regardless of the weight of luminance assigned to the sub-field, while the sustain period TS is longer as the weight of luminance is greater. That means the eight sub-fields Tsf equivalent to one field f are different from one another in length, and the length ratio of a sustain preparation period (=the reset period TR+the address period TA) to the sub-field period Tsf is larger as the weight of luminance is smaller.

Thus, PDPs, which employ a sub-field method for gradation display, and express luminous level according to the number of sustain discharges, have a problem that it is difficult to make fine setting of the weight of luminance by a single sustain discharge. For example, in expressing 256 gradations, it is impossible to make accurate setting the weight of luminance if the total number of sustain discharges is not an integral multiples of 255. Further, in PDPs, the number of gradations displayed, the number of scanning lines, and the luminance (i.e., length of the sustain period TS which is proportional to the number of sustain discharges) are in mutual relation because of a timing constraint on the length of the field f.

Therefore, if the number of scanning lines is large, as in the full-color high-definition PDPs for example, the address period TA is long. However, by reducing the number of light emissions (sustain pulses) to compensate for the long address period Ta, however, luminance declines and screen becomes dark.

In the case where the number of sub-fields is reduced to solve this problem and to obtain high luminance, humans, who are excellent in recognition of gradations, feel roughness and graininess of gradation in dark parts of an image, and thus the quality of display is impaired.

Further, conventional PDPs, compared with other display devices such as a CRT, have a greater gradation ratio of luminance to time, and has a problem in display reliability.

SUMMARY OF THE INVENTION

The present invention has been made under these circumstances. It is an object of the present invention to provide a method for driving a plasma display panel which allows improvement in accuracy of setting luminance by using plural kinds of sustain pulses different in light emission luminance, as pulses for a sustain discharge, and by adjusting the number of sustain pulses of each kind according to the weight of luminance set for each of sub-fields. It is another object of the present invention to provide a method for driving a plasma display panel which allows an increase in the substantial number of display gradations by changing the constituent ratio of plural kinds of sustain pulses according to display luminance.

The present invention provides a method for driving a plasma display panel which displays a frame composed of a plurality of sub-fields having different weights of luminance, the method comprising: using plural kinds of application voltage waveforms different in light emission luminance, as pulse voltages for sustain discharges in display of each sub-field; and adjusting the number of waves in each of the plural kinds of application voltage waveforms according to the weight of luminance set for each sub-field, thereby performing gradation display.

According to the present invention, the constituent ratio of plural kinds of application voltage waveforms can be changed for performing gradation display. Therefore, accuracy of setting the weight of luminance assigned for each sub-field is improved. Also, according to the present invention, it is possible to display an image with a more rich gradation and a higher luminance than those of conventional images without shortening the address period or the like other than the sustain period.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIGS. 1(*a*) and 1(*b*) are diagrams illustrating sustain pulses according to Embodiment 1 of the present invention and according to Comparative Example, respectively;

FIG. 2 is a diagram illustrating sustain pulses according to Embodiment 2 of the present invention;

FIG. 7 illustrates a graph of the relationship between the number of gradations and its frequency in the PDP;

FIG. 8 shows a table of ratios of luminance when the number of sub-fields is eight;

FIG. 9 illustrates a graph of an example where the constituent ratio of sustain pulses is changed in accordance with display time;

DESCRIPTION OF THE PREFERRED EMBODIMENTS

Figure 3:
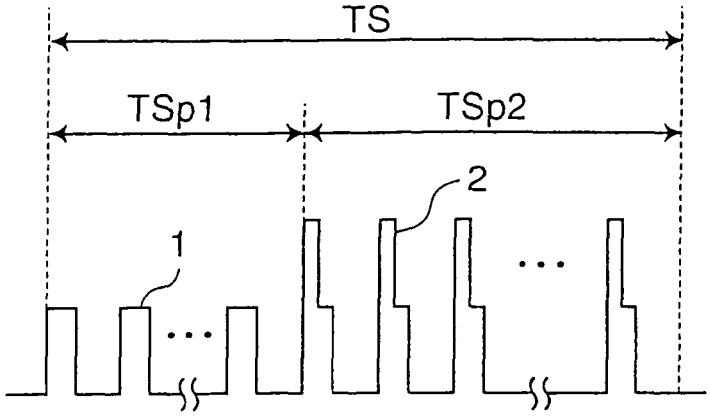
FIG. 3 is a diagram illustrating sustain pulses according to Embodiment 3 of the present invention.

In the present invention, examples of a substrate include a glass substrate, a quartz substrate, ceramic substrate and the like substrate, as well as a substrate having thereon desired structures such as electrodes, an insulating film, a dielectric layer and a protective film.

A display electrode and a selective electrode may be formed using various materials and methods known in the art. Materials for the display electrode and the selective electrode include transparent conductive materials such as ITO, $SnO_2$ and conductive metal materials such as Ag, Au, Al, Cu and Cr. Methods for forming the display electrode and the selective electrode include thick-film forming techniques such as printing, and thin-film forming techniques such as physical deposition and chemical deposition. The thick-film forming techniques include screen-printing. Of the thin-film forming techniques, examples of the physical deposition include vapor deposition and sputtering, and examples of the chemical deposition include thermal CVD, optical CVD and plasma CVD.

In the present invention, a pulse voltage (also referred to as a sustain pulse) applied during a sustain period in one sub-field is composed of a plural kinds of application voltage waveforms different in light emission luminance.

As the sustain pulse applied during the sustain period, generally used is a rectangular voltage waveform. For changing the light emission luminance of the rectangular voltage waveform, the effective value of a voltage may be changed, and for changing the effective value, the voltage in amplitude (ultimate electric potential) may be changed. In the case where the voltage in amplitude is increased only by means of the rectangular pulse, however, a narrow driving margin is resulted. Therefore, a pulse voltage waveform increased in amplification only at the rise part may be used as an application voltage waveform which is different from the rectangular waveform in light emission luminance per pulse, for changing the luminance without causing the driving margin to become narrower. For example, as the pulse voltage waveform, one disclosed in Japanese Unexamined Patent Publication No. 2003-297000 may be used.

The application voltage waveform may be modified to any extent as long as the luminance is changed, and there is no particular limitation to the number of stages in which the application voltage waveform is modified. However, providing too many stages serves to complicate control. Therefore, it is desirable to limit the number of stages to, for example, two or three. In other words, it is desirable to set, for example, two or three kinds of voltage waveforms different in light emission luminance, as application voltage waveforms.

The present invention will now be described in detail based on the embodiments shown in the drawings. It should be understood that the present invention is not limited to the embodiments, and various changes and modifications are possible.

Figure 10:
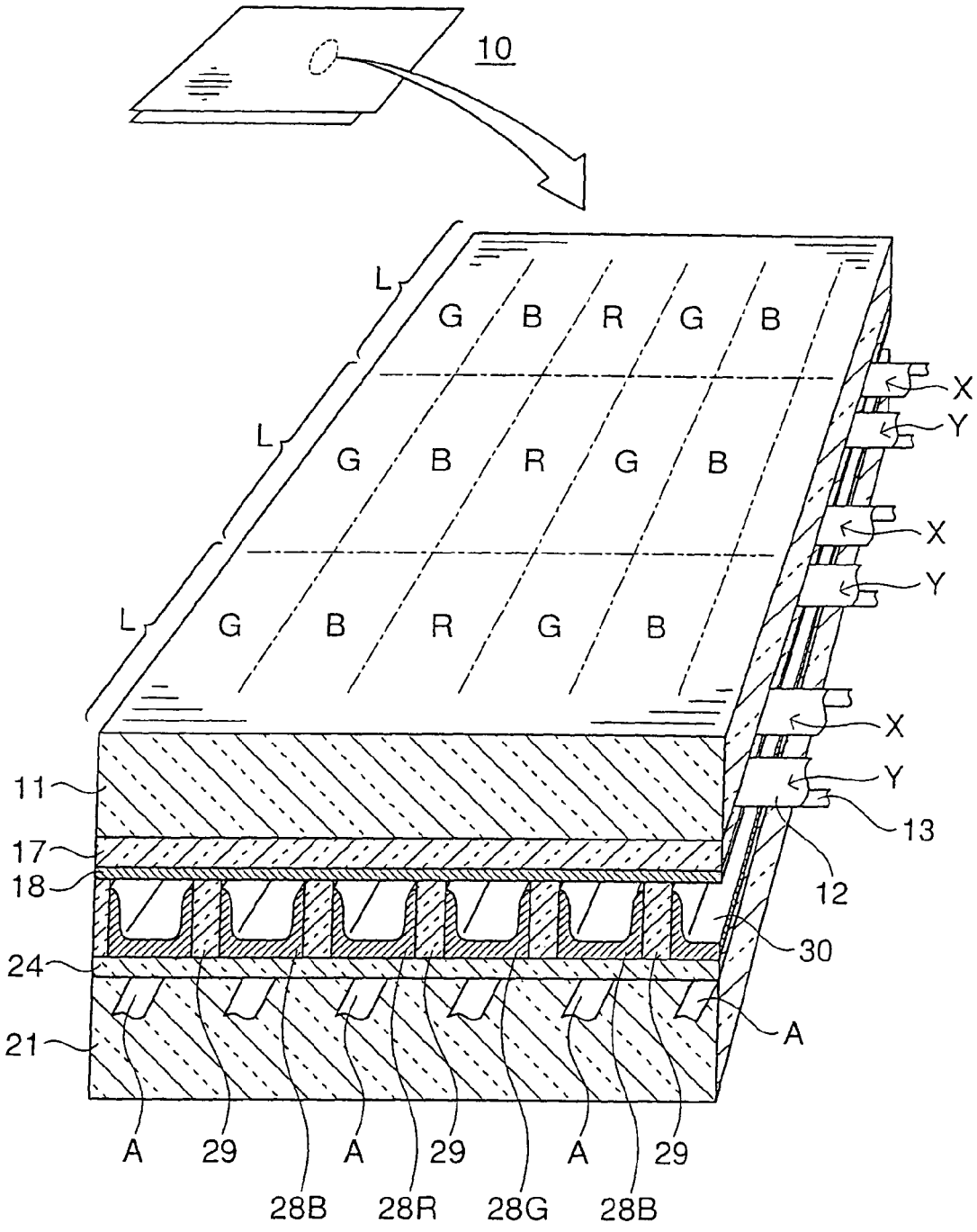
FIG. 10 (PRIOR ART)
FIG. 10 is a perspective view illustrating the construction of a conventional three-electrode surface-discharge color PDP of an AC type PDP.
Figure 11:
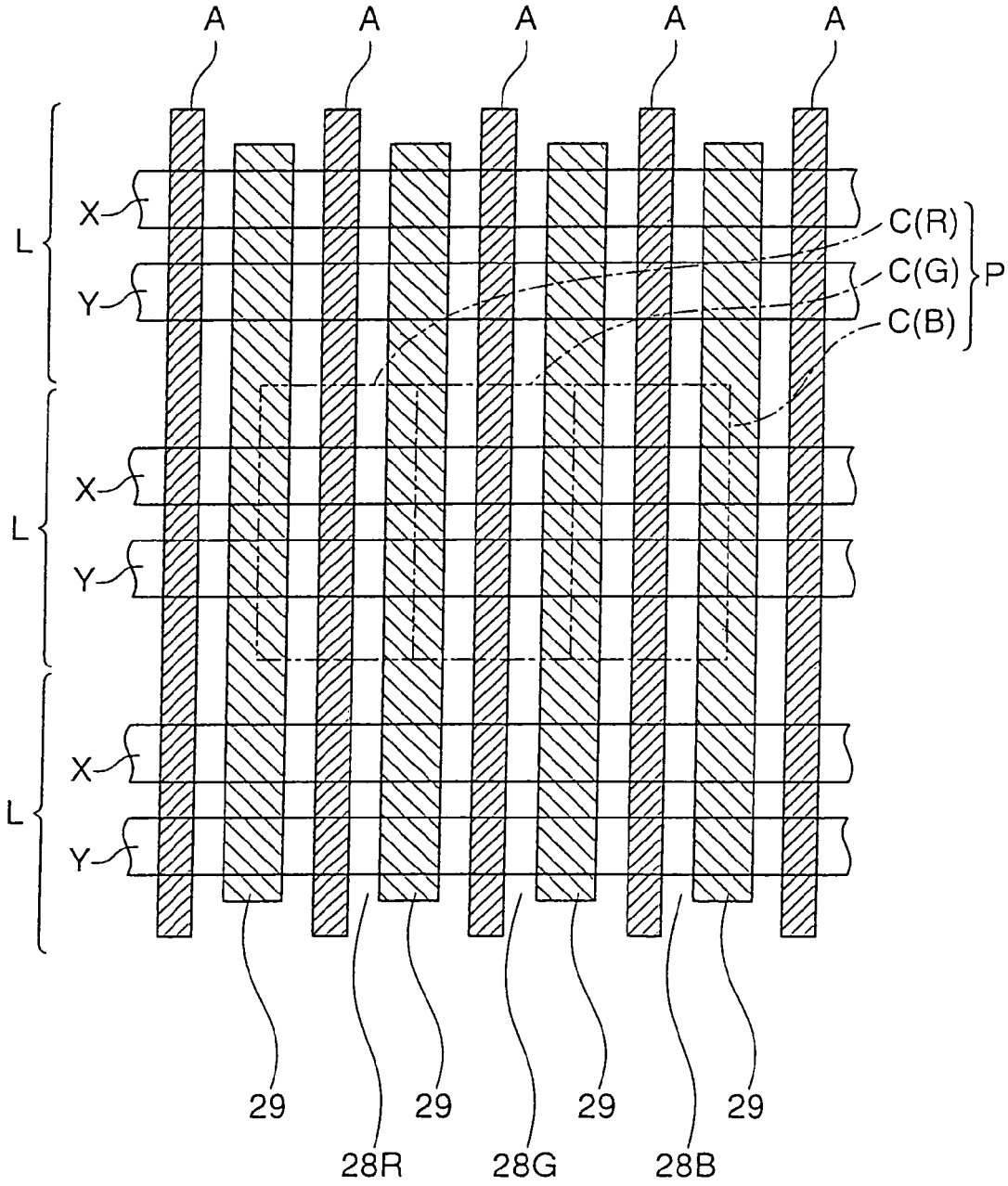
FIG. 11 (PRIOR ART)
FIG. 11 is a plan view of the PDP shown in FIG. 10.

A PDP to which a driving method of the present invention is applied has the same construction as that of the PDP shown in FIGS. 10 and 11. Also, the constitution of a field of the PDP and driving voltage waveforms according to the present embodiments are basically the same as those shown in FIG. 12, though waveforms of sustain pulses applied during the sustain period of one sub-field are different from those shown in FIG. 12. For this reason, explanation will be given only to the waveforms of sustain pulses applied during the sustain period of one sub-field in the following embodiments.

Embodiment 1

FIG. 1(*a*) is a diagram illustrating sustain pulses according to Embodiment 1 of the present invention.

In the present embodiment, sustain pulses applied during the sustain period TS in one sub-field are of two kinds different in light emission luminance, i.e., in ultimate electric potential.

Figure 12:
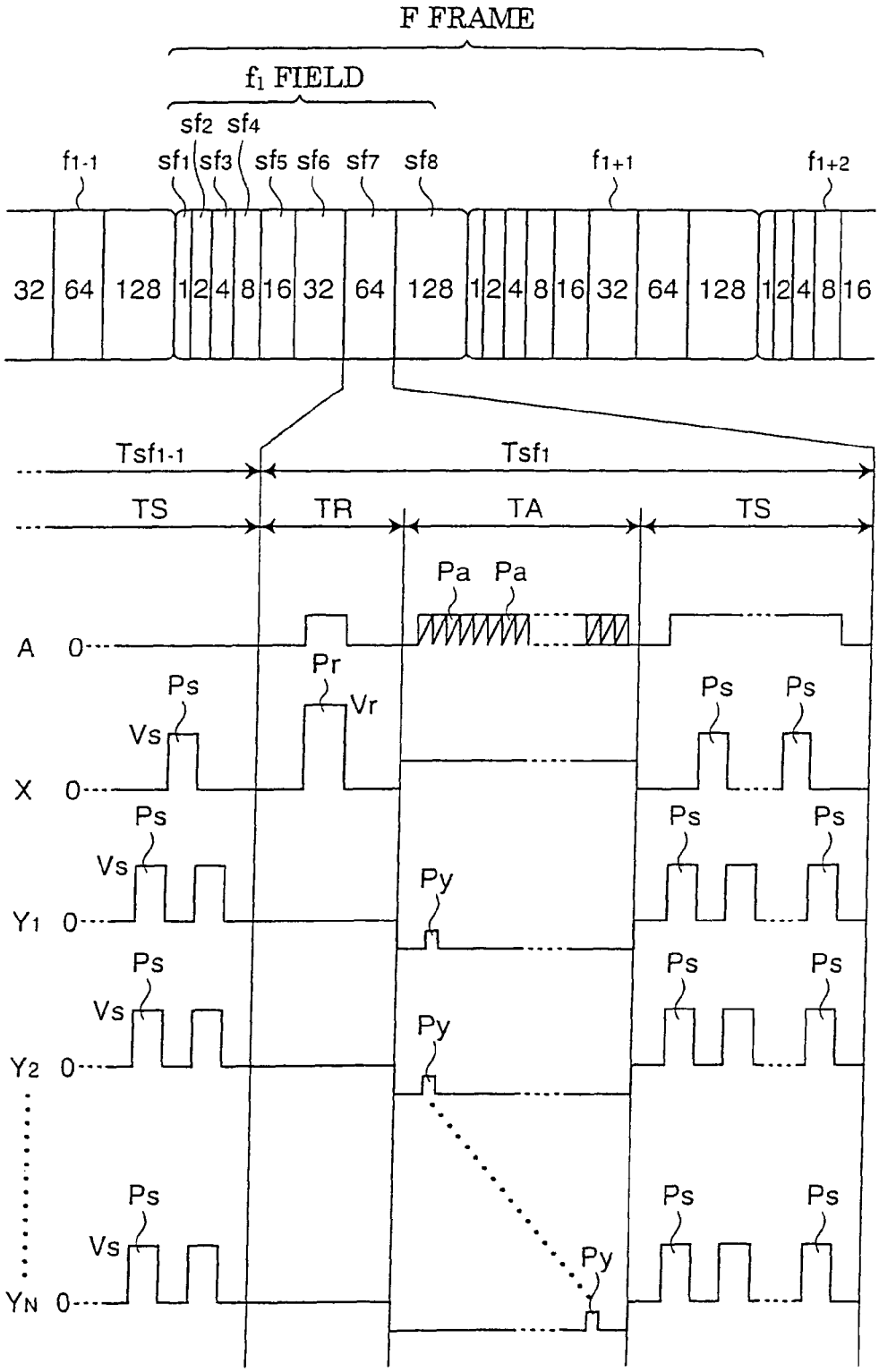
FIG. 12 (PRIOR ART)
FIG. 12 is a diagram illustrating the constitution of a field and driving voltage waveforms in the PDP shown in FIG. 10.

Of the two kinds of sustain pulses, an application voltage waveform 1, which has a low ultimate electric potential, is the same as the conventional rectangular application voltage waveform (rectangular pulse) shown in FIG. 12. Hereafter, the application voltage waveform 1 is referred to as a "rectangular pulse 1".

An application voltage waveform 2, which has a high ultimate electric potential, is one obtained by adding a priming pulse (offset voltage) to the rectangular pulse 1. Hereafter, the application voltage waveform 2 is referred to as an "offset pulse 2". Application of the offset pulse 2 may be performed using a driving circuit described in Japanese Patent Application No. HEI 11(1999)-186391 which is also an application by the applicant of the present application.

The rectangular pulse 1 and the offset pulse 2 are different in the magnitude of a single discharge (the scale of a discharge). That is, the light emission luminance of the offset pulse 2 at a discharge is higher than that of the rectangular pulse 1. Therefore, compared with application of only the rectangular pulse 1, application of the offset pulse 2 can reduce the number of pulses (the number of waves: the number of voltage applications) of a sustain pulse, and thereby enables the sustain period TS to be shorter.

FIG. 1(*b*) is a diagram for explaining a comparative example. In this example, only the rectangular pulse 1 is applied during the sustain period TS.

In terms of one sub-field, the total luminance level of the sub-field is generally proportional to the number of pulses in the sustain period TS. In the present embodiment, in which the offset pulses 2 with a high light emission luminance is used together with the rectangular pulses 1, however, the number of pulses can be reduced, and thereby the sustain period TS can be shortened, as seen by comparison between FIGS. 1(*a*) and 1(*b*).

This means that if the sustain period TS is the same in length as that in the comparative example, a larger number of sustain pulses can be applied, and therefore display can be performed with a higher luminance. Further, by adjusting the number of rectangular pulses 1 and the number of offset pulses 2 to arbitrarily change the constituent ratio of the rectangular pulse 1 and the offset pulse 2, fine adjustment of display luminance exhibited in the sub-field can be made, and thus, accuracy of setting the weight of luminance assigned to the sub-field can be improved. Also, if the adjustment of the constituent ratio of the rectangular pulse 1 and the offset pulse 2 is combined with gradation control made by illumination and non-illumination, finer control of gradation is achieved.

While in the present embodiment, two kinds of pulses different in light emission luminance are used as sustain pulses, using three or more kinds of pulses enables still finer control to be made.

Embodiment 2

FIG. 2 is a diagram illustrating sustain pulses according to Embodiment 2 of the present invention.

The present embodiment is different from Embodiment 2 in arrangement of the rectangular pulse 1 and the offset pulse 2.

As in Embodiment 1, in the case where the two kinds of sustain pulses are arranged by being gathered by kind, uneven wall charges might possibly be formed in particular areas depending on the structure of a cell in a unit discharge space, and thereby the wall discharges in the discharge space might not be uniformly reset in the reset period.

In the present embodiment, two kinds of sustain pulses different in light emission luminance are arranged alternatively. That is, the rectangular pulses 1 and the offset pulses 2 are arranged alternatively. This allows formation of even wall charges in the discharge space, and facilitates uniform reset of the wall discharges in the reset period. Consequently, stable display in the PDP can be achieved.

Embodiment 3

FIG. 3 is a diagram illustrating sustain pulses according to Embodiment 3 of the present invention.

In the present embodiment, the sustain pulses with a low ultimate electric potential are arranged by being gathered in a phase TSp1 of the sustain period TS which in this embodiment serves as a former half phase, and the sustain pulses with a high ultimate electric potential are arranged by being gathered in a phase TSp2 which in this embodiment serves as a latter half phase. Namely, the rectangular pulses 1 are arranged by being gathered in the phase TSp1 of the sustain period TS, and the offset pulses 2 are arranged by being gathered in the phase TSp2.

The offset pulse 2, which has a high ultimate electric potential, generates a discharge of greater magnitude. The offset pulse 2, therefore, eradicates uneven charges having been formed by a discharge of smaller magnitude generated by the rectangular pulse 1 in the former period TSp1 of the sustain period TS, and assists wall charges being uniformly formed in the discharge space. Consequently, stable display in the PDP can be achieved.

Embodiment 4

Figure 4:
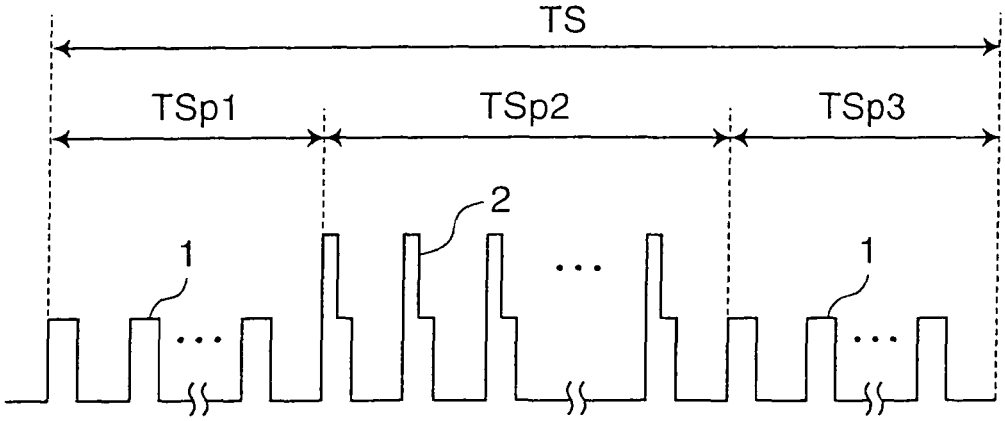
FIG. 4 is a diagram illustrating sustain pulses according to Embodiment 4 of the present invention.

FIG. 4 is a diagram illustrating sustain pulses according to Embodiment 4 of the present invention.

In the present embodiment, the rectangular pulses are arranged by being gathered in the phase TSp1 of the sustain period 1 which in this embodiment serves as an initial phase, the offset pulses 2 are arranged by being gathered in the phase TSp2 which in this embodiment serves as a middle phase, and the rectangular pulses 1 are again arranged by being gathered in the phase TSp3 which in this embodiment serves as a final phase.

Depending on the cell structure in the PDP, it happens in some cases that applying the offset pulses 2, which have a high ultimate electric potential, causes an increase in the amount of an electric charge unevenly formed in a particular area. Against the PDP with such a cell structure, the rectangular pulses 1, which serve for adjusting electric charges, are again arranged by being gathered in the phase TSp3. Consequently, stable display can be achieved even in a PDP with an arbitrary cell structure.

Embodiment 5

Figure 5:
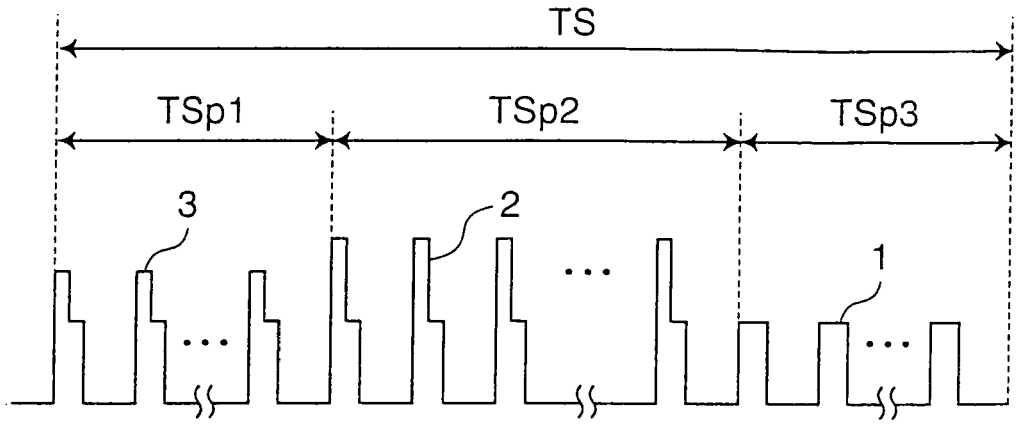
FIG. 5 is a diagram illustrating sustain pulses according to Embodiment 5 of the present invention.

FIG. 5 is a diagram illustrating sustain pulses according to Embodiment 5 of the present invention.

In the present embodiment, arranged in the sustain period TS are three kinds of sustain pulses: sustain pulses with an intermediate ultimate electric potential (intermediate pulses 3), sustain pulses with a high ultimate electric potential (offset pulses 2), and sustain pulses with a low ultimate electric potential (rectangular pulses 1).

That is, the intermediate sustain pulses 3 are arranged by being gathered in the phase TSp1 of the sustain period TS as the initial phase, the offset pulses 2 are arranged by being gathered in the phase TSp2 as the middle phase, and the rectangular pulses 1 are arranged by being gathered in the phase TSp3 as the final phase.

Using three kinds of sustain pulses different in light emission luminance as mentioned above enables still finer control of gradations to be made than in the case of two kinds of sustain pulses. Also, an effect equivalent to that in Embodiment 4 can be obtained.

Figure 6:
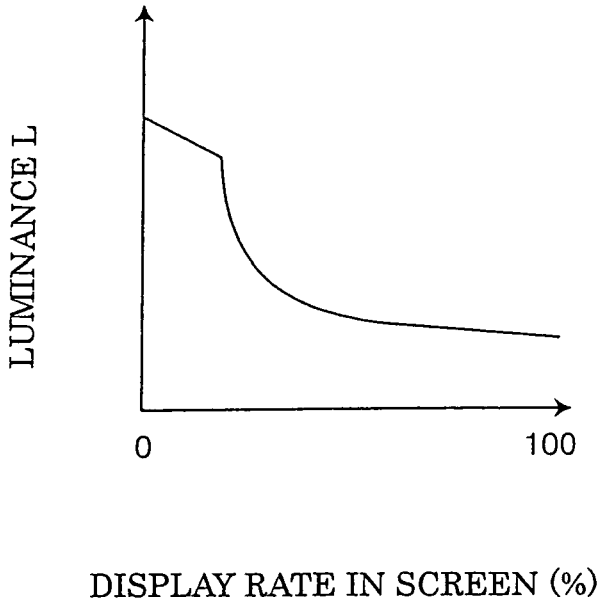
FIG. 6 illustrates a graph of the relationship between the display rate in screen (%) and the luminance (L: lux) in a PDP.

FIG. 6 illustrates a graph of the relationship between display rate in screen (%) and luminance (L: lux), i.e., panel-load characteristic in the PDP. The display rate in screen, which is a ratio of luminous cells to the entire cells present in the screen, varies for each frame.

The display rate in screen is 30% or lower in many cases when an ordinary moving image is displayed. In display in the PDP, the number of sustain pulses is generally increased in a frame having a low display rate in screen so that a high luminance is achieved, while the number of sustain pulses is decreased in a frame having a high display rate in screen so that power consumption is reduced, as indicated with the graph. Also, this enables the PDP to display an image in which the dynamic range of gradations is wider than that of gradations in an image displayed by a liquid crystal panel or the like.

According to the present invention, it is possible to display a high quality image which has a still wider dynamic range of gradations by, in addition to a control of the number of sustain pulses, using a plural kinds of sustain pulses different in light emission luminance, and further by changing the constituent ratio of the plural kinds of sustain pulses.

FIG. 7 illustrates a graph of the relationship between the number of gradations and its frequency (the number of dots: the number of cells) when the range of gradations in display image data is narrower than that given by the maximum number of gradations $2^n$ (n is the number of sub-fields). This is a graph obtained when one field is composed of eight sub-fields. Here, the substantial number of display gradations can be increased if any one of the controls in Embodiments 1 to 5 is carried out.

FIG. 8 shows a table of the ratio of luminance when the number of sub-fields is eight.

This table provides the ratio of luminance in the sub-fields when an image with 256 gradations (substantially an 8-bit image) is displayed, i.e., the ratio of luminance in the sub-fields sf1 to sf8 when the rectangular pulses and the offset pulses are applied in the constituent rates below in the sustain period of one sub-field. The luminance ratio of the offset pulse to the rectangular pulse is 1.0:0.5.

The constituent rate shows the ratio of the offset pulse to the rectangular pulse: 100% is defined as one when only the offset pulses are applied, 50% is defined as one when the offset pulses and the rectangular pulses are applied in the constituent ratio of 1:1, and 0% is defined as one when only the rectangular pulses are applied.

Comparative example shows a ratio of luminance in the sub-fields when only the offset pulses are applied for displaying an image with 256 gradations (substantially an 8-bit image).

Constitution (1) shows a ratio of luminance in the sub-fields according to the present invention when the offset pulses and the rectangular pulses are applied in the constituent ratio of 1:1. In the case where the constituent ratio of pulses is 1:1 as above, a specific display image, in which the maximum number of gradations (the highest luminance) is not larger than "191.25 (sum of numerical values of the ratio of luminance in the sub-fields)" (for example, an image indicated in FIG. 7), can be displayed with an increased number of gradations by 256/191.25-fold (substantially 12-bit display can be performed). This means that though the displayable highest numerical value of luminance is "191.25", the number of substantial gradations can be increased because the image can be displayed with the displayable highest numerical value "191.25" of luminance being approached by 256 steps.

Constitution (2) shows a ratio of luminance in the sub-fields when only the rectangular pulses are applied. In the case where only the rectangular pulses are applied as mentioned above, a specific display image in which the maximum number of gradations (the highest luminance) is not larger than "127.5 (sum of numerical values of the ratio of luminance in the sub-fields)" (for example, an image indicated in FIG. 7) can be displayed with an increased number of gradations by 256/127 fold (substantially 16-bit display can be performed). This means that though the displayable highest numerical value of luminance is "127", the number of substantial gradations can be increased because the image can be displayed with the displayable highest numerical value "127" of luminance being approached by 256 steps.

As described above, by applying the present invention, it is possible to display a specific display image with an increased number of gradations and an improved quality compared with conventional techniques.

FIG. 9 illustrates a graph of an example where the constituent ratio of sustain pulses is varied in accordance with display time.

This graph shows display time T as the axis of abscissa plotted against light emission luminance L as the axis of ordinate. In this example, a plural kinds of sustain pulses different in light emission luminance are present in the sustain period of one sub-field. The constituent ratio of the plural kinds of sustain pulses are changed in accordance with display time T of a display device so that luminance L is provided as shown in the graph.

By changing the constituent ratio of sustain pulses in accordance with display time as described above, it is possible that PDPs with applications in a specific field such as the field of information display monitors or the like are driven with small changes in luminance and with stability in display.

As mentioned above, according to the present invention, the number of substantial display gradations can be increased by constituting sustain pulses applied in the sustain period of one sub-field of plural kinds of sustain pulses different in light emission luminance and changing the constituent ratio of the plural kinds of sustain pulses.

Therefore, according to the present invention, more accurate setting of weights of luminance can be made by using plural kinds of application voltage waveforms different in light emission luminance, as sustain pulses, and adjusting each of the application voltage waveforms in accordance with the weight of luminance set for each of sub-fields. Further, according to the present invention, gradation display can be performed not only by illumination/non-illumination on a sub-field basis, but also by different constituent ratios of the plural kinds of application voltage waveforms. Consequently, it is possible to display an image with a more rich gradation and a higher luminance than conventional images without shortening the address period or the like other than the sustain period.

What is claimed is:

1. A method for driving a plasma display panel displaying a frame composed of a plurality of subfields, comprising:

applying first and second sustain pulses having at least two kinds of waveforms different in luminance, the second sustain pulse having a higher luminance than the first sustain pulse, and the first and second sustain pulses being applied according to a weight of luminance to be given to the sub-fields at a predetermined constituent ratio in a sustain period of at least one sub-field; and adjusting the constituent ratio of the first and second sustain pulses according to a maximum luminance of the frame to be displayed wherein, if the maximum luminance of the frame to be displayed is lower than a luminance of a maximum gradation corresponding to the number of sub-fields, a constituent ratio of the first sustain pulse is increased such that the luminance of the maximum gradation decreases.

2. The method of claim 1, wherein the first sustain pulse has a rectangular waveform and the second sustain pulse has a waveform in which a voltage changes in two or three stages.

3. The method of claim 1, wherein the first sustain pulse has a rectangular waveform and the second sustain pulse has a waveform with a larger amplitude than the rectangular waveform of the first sustain pulse only at a rising part of the second sustain pulse.

4. The method of claim 1, wherein, when a frame having low maximum luminance is displayed, the sustain period consists of a waveform having relatively low luminance among plural kinds of sustain pulses and, when a frame having high maximum luminance with respect to other frames is displayed, a constituent ratio of sustain pulses having relatively high luminance with respect to other sustain pulses is increased such that a luminance of a maximum gradation increases.

5. The method of claim 1, wherein a total number of the first and second sustain pulses included in the frame to be displayed is decreased according to an increase of a display rate of a screen of the plasma display panel in addition to the adjustment of the constituent ratio of the first and second sustain pulses in the sustain period of at least one of the plurality of sub-fields.

* * * * *